US008708740B2

(12) United States Patent
Liou

(10) Patent No.: US 8,708,740 B2
(45) Date of Patent: Apr. 29, 2014

(54) WATERPROOF RADIO ACCESSORY CONNECTOR ASSEMBLY

(76) Inventor: Henry Liou, Brea, CA (US)

( * ) Notice: Subject to any disclaimer, the term of this patent is extended or adjusted under 35 U.S.C. 154(b) by 0 days.

(21) Appl. No.: 13/370,791

(22) Filed: Feb. 10, 2012

(65) Prior Publication Data

US 2013/0128476 A1 May 23, 2013

Related U.S. Application Data

(63) Continuation of application No. 29/407,105, filed on Nov. 22, 2011.

(51) Int. Cl.
*H01R 13/58* (2006.01)

(52) U.S. Cl.
USPC ..... 439/604

(58) Field of Classification Search
USPC ..... 439/604, 700, 362, 341, 76.1
See application file for complete search history.

(56) References Cited

U.S. PATENT DOCUMENTS

| | | | | |
|---|---|---|---|---|
| 5,415,561 | A * | 5/1995 | Mavrin et al. | 439/341 |
| 5,913,688 | A * | 6/1999 | Marian, Jr. | 439/76.1 |
| 6,162,093 | A * | 12/2000 | Sudol et al. | 439/607.01 |
| 6,902,412 | B2 * | 6/2005 | Higgins | 439/101 |
| 7,927,140 | B2 * | 4/2011 | Beck | 439/606 |

* cited by examiner

*Primary Examiner* — Phuong Dinh
(74) *Attorney, Agent, or Firm* — Vieira and Associates; Erik M. Vieira

(57) ABSTRACT

A novel method, apparatus, and system are disclosed for a waterproof connector assembly apparatus, adapted to provide electromagnetic interface connectivity between a communications accessory device and a two-way radio. The waterproof connector assembly apparatus comprises a circuit board member, affixing means for at least one pin, a rigid chassis member adapted for mounting the circuit board member, a flexible overmold, and an affixing member adapted to affix the waterproof connector assembly apparatus to the two-way radio.

14 Claims, 3 Drawing Sheets

WATERPROOF RADIO ACCESSORY CONNECTOR ASSEMBLY

CROSS-REFERENCE TO RELATED APPLICATIONS

This application is a continuation application of pending U.S. patent application Ser. No. 29/407,105, filed Nov. 22, 2011, entitled Waterproof Radio Accessory Connector Assembly.

BACKGROUND

1. Field

The present disclosure generally relates to a flexible connector apparatus for connecting a radio to an accessory device and is waterproof.

2. Related Art

Various types of personal radio systems, which necessarily include a portable receiving unit, are now commonplace. In some systems, the portable radio may comprise a transceiver for providing two-way communications between two individual users or between a single user and a group of other users. A base station or repeater receives a signal from the calling unit and re-transmits the signal to one or more called units.

A trunked radio repeater system is one such personal radio system in widespread use today. In the trunked system, a pair of radio frequencies is assigned to a group of public service users, such as a fire department, police department, or emergency service providers. Each radio frequency group includes an inbound working channel for carrying traffic from a user to a base station or a repeater, and an outbound working channel for carrying communications traffic from the repeater to the intended recipients. Each user is equipped with a portable transceiving unit, typically referred to as a portable radio, for communicating with members of his or her group. Generally, the portable radios are hand-held or received within a harness assembly strapped to a user so that the radio is readily accessible. The portable radio may also be temporarily stored in a pocket of the user's clothing, set upon a work surface, or used within a vehicle.

When a user initiates a call, the trunked radio system assigns a frequency pair (including an inbound working channel and an outbound working channel) to the call. Once the call has been set up, the calling party talks into the portable radio or into an accessory microphone connected to the portable radio. The voice signal is sent to the base station over the inbound working channel and then broadcast to all members of the calling party's group over the outbound working channel.

It is common practice for the radio to have a multi-pin electrical connector accessible at an external surface of the portable two-way radio unit. A number of accessories can thereby be connected to the portable radio so as to become an integral part of the radio system. Certain of these radio accessories offer the user an opportunity to enjoy hands-free operation of the portable radio. Other accessories provide remote control operations and/or functions that may not be available within the basic portable radio.

One accessory that facilitates hands-free operation is a remote speaker/microphone. The remote speaker/microphone is typically worn on the user's shoulder and connects to the portable radio through a cable and connector, while the portable radio remains attached to the harness assembly by or near the user's belt. The remote speaker/microphone brings a majority of the basic radio functions to the user's shoulder, for example, a push-to-talk button by which the user can activate the portable radio to place a call. When use of the radio is transitioned to the vehicular environment, the remote speaker microphone and related accessories can be disengaged from the portable radio at the multi-pin connector, followed by the engagement of a different accessory device for interfacing with one or more related systems within the vehicle, such as a power supply for recharging the portable radio battery, a speaker mounted within the vehicle, and a microphone also mounted within the vehicle. Depending upon the preferences of the user, accessory devices may be changed as the portable radios are swapped from one user to another. Frequent swapping, with attendant changes in accessory devices, to fatigues the interconnect system.

Typically, the portable radio user is engaged in public safety matters, such as a police officer, fire fighter, military or ambulance personnel. The radio is therefore often subjected to extreme environments, such as high-pressure water flows and high stress scenarios where reliable and immediate availability of the portable radio, including proper functioning of the connector of the present teachings, is extremely critical.

As discussed above, the portable radio is generally received within a harness and given the size and bulk of the radio, it is usually only semi-rigidly attached to the operator. The cord leading from the accessory device terminates in a multi-pin connector for mating with the connector of the portable radio. When the accessory speaker/microphone is mounted to the user's shoulder, the cord typically runs along the operator's body, generally from the waist to the shoulder. In the prior art, the accessory cord connector is a moderately large protrusion extending from the side of the radio when mated thereto. It is commonly bumped and subject to jarring forces from many directions during use. For instance, mechanical damage occurs most often when the user enters or exits a vehicle, door or arm-chair while wearing other equipment or gear. The cord easily becomes tangled as a fire fighter crawls along a debris-strewn floor or through a small passage, or while a police officer is chasing a fleeing criminal. In short, any time the connector body comes in contact with an immovable object, it is generally the former that is damaged.

In one prior art embodiment, the accessory connector is removably attached to the portable radio by a single screw penetrating through the connector and mating with a threaded hole in the portable radio body. See for example U.S. Pat. No. 4,792,986. It is common practice for users to over tighten the screw in an effort to maintain a waterproof seal at the connector interface. Under emergency and stressful conditions, it can prove difficult to accurately align the connector (12 pins in one embodiment) with the mating holes and then actuate the screw to tighten the connector in place. Over-tightening the screw can cause it to shear, requiring replacement of the connector and perhaps a repair of the portable radio if the broken screw remains lodged in the mating screw hole. Under-tightening the connecting screw provides poor electrical connection between the connector halves.

To prevent connector misalignment during the connecting process and while in use, certain field modifications have been attempted, including the use of metal straps and hooks to hold the connector to the portable radio. The metal straps frequently snag on the user and deform out of shape. The plastic hooks eventually wear out and require replacement. In extreme situations, the prior art connector is bonded to the portable radio to prevent connector movement relative to the portable radio. These attempted prior art modifications render it difficult, and in some cases impossible, to disconnect the portable radio from a first accessory device, for instance the speaker/microphone device, and connect it to a second accessory device, for example, vehicular accessories.

Referring to the patent mentioned above (U.S. Pat. No. 4,792,986), a threaded knurled knob is used as the single point of attachment between the connector and the portable radio body. It is known that a single screw cannot prevent rotational movement of the connector relative to the portable radio Rotation through any angle greater than approximately 15 degrees causes loss of electrical connection between one or more of the contacts. If the mating electrical contacts comprise pins and mating holes, such rotation of the connector can cause bending of the pins, or in extreme cases, breaking of one or more pins. In an effort to prevent these occurrences, and under the belief that tighter is always better, users will tighten the screw as tight as possible. As mentioned above, in extreme cases the screw will shear under the extreme forces imposed upon it.

In addition to a relatively quick release electrical connector for the purpose of changing between various accessory devices such as those worn by an individual user to those carried in a vehicle, it should also be noted that certain features of the radio can be programmed through use of yet another accessory device. As explained in detail in U.S. Pat. No. 4,792,986, the portable radio senses the resistance or impedance between specified pins of the electrical connector (or between a specified pin and ground) and in this way determines the nature and function of the accessory to which the portable radio is connected. In response to the measured impedance value, the internal computer-controlled circuits of the portable radio automatically reconfigure the portable radio mode of operation. As discussed in the aforementioned patent, one of the unique resistance values identifies an external controller for reprogramming certain internal functions of the portable radio. Another unique resistance value identifies the external speaker/microphone as the accessory device connected to the portable radio. Yet another resistance value identifies the vehicular accessories.

As discussed above when the accessory connector is not tightly mated with the portable radio, rotation of the accessory connector relative to the radio body can change the resistance value or break the electrical connections between contacts. In the event the sensed resistance value changes, the portable radio will switch operational modes, although the same accessory device remains attached to the portable radio. If the operative contacts to the attached accessory device are instead broken, while the sensed contacts remain intact and with no change to the measured resistance value, the portable radio will continue to operate as though the speaker/microphone is attached. As a result, the radio controller mutes the speaker within the radio body, rendering the entire unit useless, (assuming there is no provision for manually activation of the radio speaker).

Typically, the connectors used to interface accessories with two-way hand held radios are constructed with a hard plastic shell containing electronic circuit board(s), pins to contact with a radio connector, sub-assembly mechanical components to secure internal components, and some means to affix the connector to the two-way radio. As described above, problems with the current methods of connector construction include, that there are many parts to assemble and these parts can be broken by misuse. The present teachings solve these problems, as will now be described.

SUMMARY

In one embodiment, a quick disconnect waterproof connector assembly apparatus, adapted to provide electromagnetic interface connectivity between a communications accessory device and a two-way radio is disclosed. The quick disconnect waterproof connector assembly generally comprises a quick disconnect interface member, a circuit board member, at least one pin, a rigid chassis member, a flexible overmold, and an affixing member.

In one embodiment, a waterproof connector assembly apparatus is disclosed. The waterproof connector assembly apparatus generally comprises a cable member, a circuit board member, a rigid chassis member, a flexible overmold, and an affixing member.

BRIEF DESCRIPTION OF THE DRAWINGS

Embodiments of the present disclosure will be more readily understood by reference to the following figures, in which like reference numbers and designations indicate like elements.

DETAILED DESCRIPTION

Overview

The present teachings disclose a method, apparatus, system and article of manufacture for a waterproof connector assembly apparatus, adapted to provide electromagnetic interface connectivity between an external accessory device and a two-way radio. The present disclosure overcomes a myriad of limitations due to hard plastic housings on electrical connectors cracking or breaking and the problems that arise therefrom by eliminating the hard plastic housing. The present teachings describe how to make and use a smaller, more ergonomic, waterproof, and lower cost assembly apparatus for an electrical connector for passing bi-directional electromagnetic communications signals in audio and/or data format, than is currently available in the art. The waterproof connector assembly apparatus is further adapted to be flexible, which allows for greater tolerance to misuse, abuse, cracking or breaking.

Figure 1A:
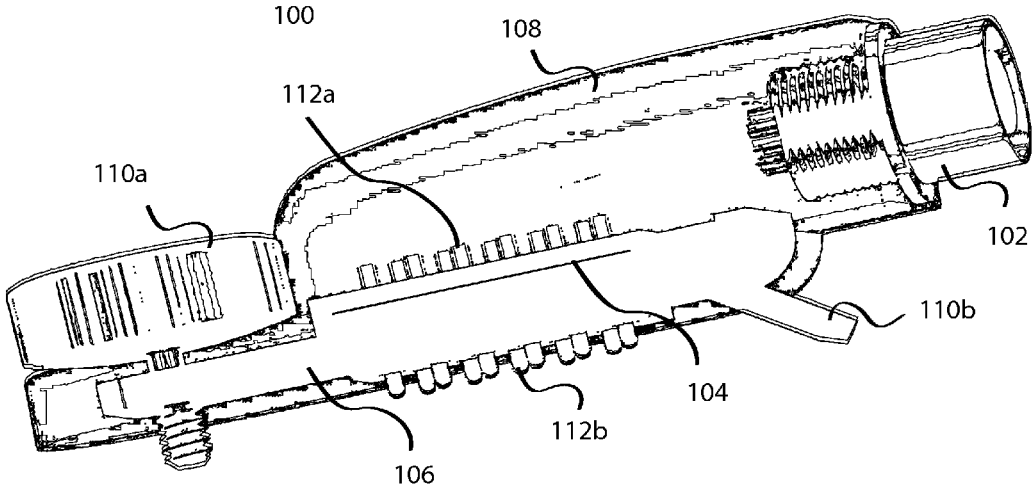
FIG. 1*a* illustrates a cross-sectional perspective view of a quick disconnect connector assembly apparatus, according to one embodiment of the present teachings.
Figure 1B:
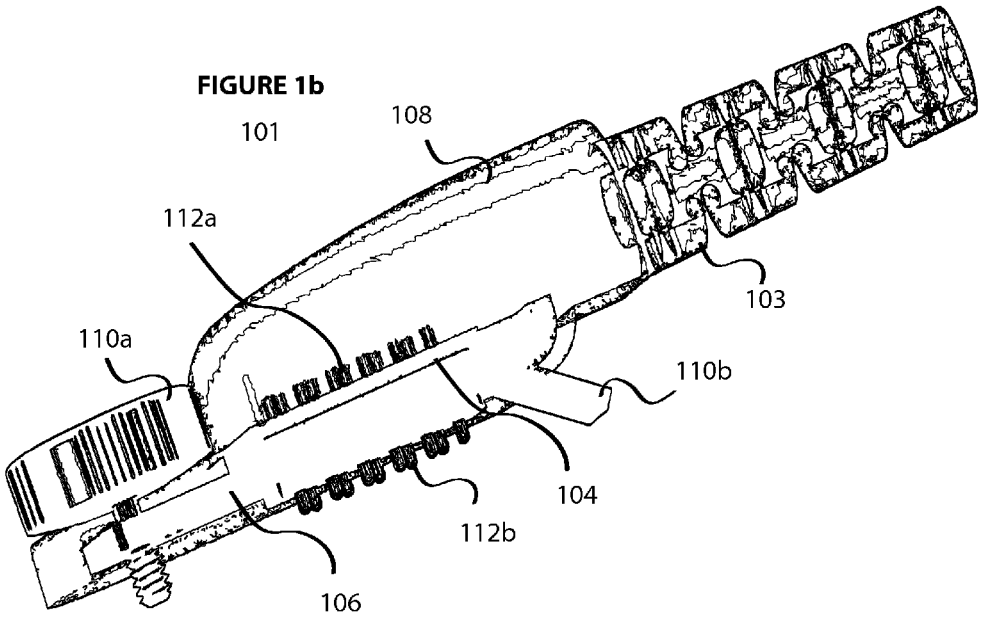
FIG. 1*b* illustrates a cross-sectional perspective view of a waterproof connector assembly apparatus, according to one embodiment of the present teachings.
Figure 1C:
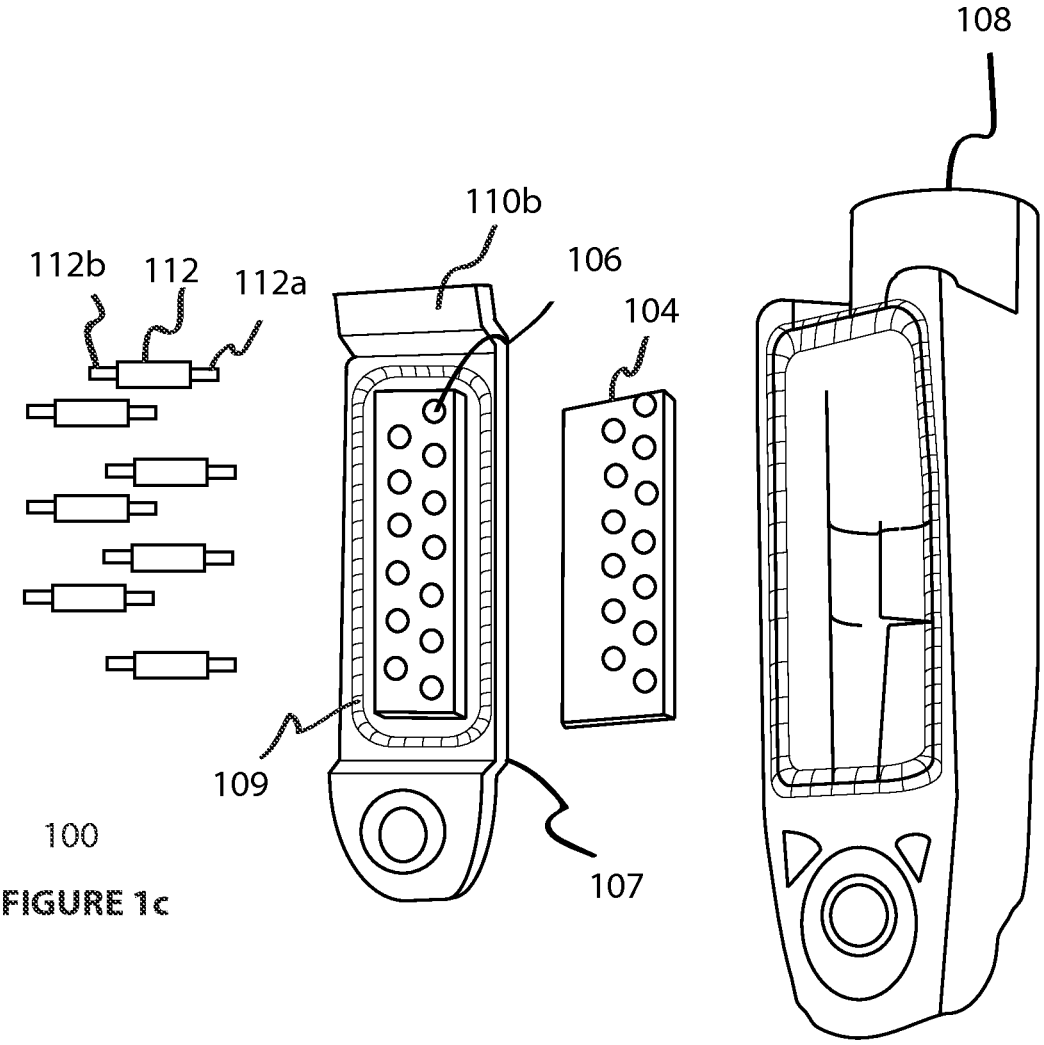
FIG. 1*c* illustrates an exploded view of a waterproof connector assembly apparatus, according to one embodiment of the present teachings.

Referring now generally to FIG. 1*a* and FIG. 1*c*, one embodiment of a quick disconnect waterproof connector assembly apparatus 100 is disclosed. The quick disconnect waterproof connector assembly apparatus 100 generally comprises a quick disconnect interface member 102, a circuit board member 104, a rigid chassis member 106, a flexible overmold 108, and an affixing member 110*a* and/or 110*b*. In one exemplary embodiment, a user inserts an external accessory device via a quick disconnect interface member 102.

The quick disconnect waterproof connector assembly apparatus 100 is adapted to transfer bi-directional electromagnetic signals, employing a quick disconnect interface member 102, between a two-way radio and an external accessory device, such as, inter alia, a speaker, microphone, GPS headset, Push-To-Talk ("PTT"), and/or power source. The quick disconnect interface member 102 is adapted to pass audio signals and/or data signals bi-directionally. In one embodiment, a quick disconnect interface member 102 is adapted for analog modulated signals, such as amplitude modulation, frequency modulation, or phase modulation. In one embodiment, a quick disconnect interface member 102 is adapted for digitally modulated signals, such as, inter alia, frequency shift keying, amplitude shift keying, phase shift keying, quadrature phase shift key, and/or quadrature amplitude modulation. The quick disconnect interface member 102 is adapted to rapidly connect and disconnect an external accessory device. The quick disconnect interface member 102 comprises at least one electrical termination member, adapted for accepting a connector element from an external accessory device, adapted for facilitating bi-directional electrical communication of audio and/or data signals. Moreover, the quick disconnect interface member 102 further optionally comprises a select function, which automatically detects when an external accessory device has been connected or disconnected. When an external accessory device is connected to the quick disconnect interface member 102, the select function is triggered via the mechanical insertion of an external accessory device connector element, which functions to send a connect signal to the two-way radio to switch from using the two-way radio's internal speaker/microphone to using the external accessory device. When the external accessory device is disconnected, whereby the external accessory device connector element is withdrawn from the quick disconnect interface member 102, a disconnect signal is automatically sent to the two-way radio, to switch back speaker/microphone functionality to the internal speaker/microphone. In one embodiment, a speaker/microphone pin is disposed at a terminal end of a quick disconnect interface member 102, whereat an external accessory device speaker/microphone connector element is inserted, which functions to ground a voltage level of a control pin, which signals to a two-way radio to transfer speaker/microphone functionality to the external accessory device speaker microphone. When the external accessory device speaker/microphone connecter element is withdrawn from the quick disconnect interface 102, the control pin voltage becomes open, thereby signaling the two-way radio to resume using its internal speaker/microphone.

In one embodiment, a PTT device is the external accessory device. The PPT, which has been used for a long time in a two-way wireless transceiver that switches transmission/reception by performing FM, AM, or PM modulation using one frequency, is a transmission/reception switchover technique recently used by many wireless stations. For example, a user presses a PTT button during talking, and releases the PTT button during listening. By manipulating the PTT button attached to a side surface of the handset transceiver or TRS terminal, the user can perform one-to-one or one-to-many communications.

The quick disconnect waterproof connector assembly apparatus 100 further comprises a circuit board member 104. In one embodiment, a circuit board member 104 comprises a printed circuit board ("PCB"), comprising a plurality of layers.

The circuit board member 104 is adapted for affixing at least one pin 112 therein. The at least one pin 112 is adapted to provide electrical contact between a two-way radio (not shown) and an external accessory device (not shown) to establish an electromagnetic communications interface therebetween. The at least one pin 112 is composed of high grade conductive, high temperature tolerant materials.

The at least one pin 112 comprises a proximate pin end 112*a*, proximate to the quick disconnect interface member 102, which is operatively coupled mechanically and electrically to the quick disconnect interface member 102, disposed at least partially within a flexible overmold 108. In one embodiment, a proximate pin end 112*a* comprises a spring coupling, having a restoring force which is substantially orthogonal to a plane of a circuit board member 104. The spring coupling of the proximate pin end 112*a* is operatively coupled to a quick disconnect interface member 102, and is further adapted to bidirectionally pass electromagnetic signals from an external accessory device, such as, inter alia, audio, digital, and PTT.

The at least one pin 112 further comprise a distal pin end 112*b*, distal to the quick disconnect interface member 102, adapted to protrude downwardly beyond an external bottom surface of the quick disconnect waterproof connector assembly apparatus 100. In one embodiment, a distal pin end 112*b* comprises a spring coupling, having a restoring force which is substantially orthogonal to a plane of a circuit board member 104. The spring coupling of the distal pin end 112*b* is operatively coupled to a proximate pin end 112*a*, and is further adapted to bidirectionally pass electromagnetic signals from an external accessory device to a two-way radio.

The quick disconnect waterproof connector assembly apparatus 100 further comprises a rigid chassis member 106. The rigid chassis member 106 is adapted for mounting a circuit board member 104, and further adapted to have a plurality of holes 107, as illustrated in FIG. 1*c*, disposed in alignment with corresponding holes in a circuit board member 104, such that the at least one pin 112 is fitted therethrough in a substantially orthogonal orientation. The rigid chassis member 106 is composed of a hardened material, such as for example hardened plastic, which is rigid enough to withstand high temperature from an overmolding process (as will be described below). In one embodiment, as illustrated in FIG. 1*c*, a rigid chassis member 106 further comprises a rubber gasket 109. The rubber gasket 109 is disposed coplanar with the rigid chassis member 106, forming a radio mating surface. The radio mating surface is adapted to form a waterproof, stronger seal with a two-way radio connector mating surface, than is currently available in the art.

The quick disconnect waterproof connector assembly apparatus 100 further comprises a flexible overmold 108, adapted to encapsulate the circuit board member 104 and further adapted to encapsulate the rigid chassis member 106. The at least one pin 112 is adapted to protrude partially outwardly from the flexible overmold 108.

Overmolding is an injection molded process whereby two or more plastic and/or elastomeric materials are molded simultaneously within the same tool. Proper materials selection is critical to assure the materials will remain bonded over the life of the part. The overmolding process taught herein reduces assembly costs, due to lower overall parts count; enables rapid prototyping design modifications, due to enhanced design flexibility by adding molded-in features; eliminating insertion of plastic parts; and adding to overall mechanical flexibility by the addition of elastomeric material to a rigid component. In one embodiment, a technique of Insert Molding is employed, wherein a pre-molded insert is placed into a mold and a thermoplastic elastomer ("TPE") is shot directly over it. In one embodiment, Multiple Material Molding is employed as a "two-shot" molding, requiring multiple barrels allowing for multiple materials to be shot in the same mold during the molding cycle. According to the present teachings, overmold TPEs have excellent adhesion to a wide variety of substrates, including polyolefins, such as poloypropylene and polyethylene, engineering resins such as acetal and nylon.

The present teachings obviate the need for a standard connector housing, which has led to broken, misused, or unreliable operational integrity, as described above. The present disclosure eliminates the need for a connector housing, thereby also reducing assembly and materials costs and reducing failure points. A flexible overmold 108 functions to protect operational and mechanical integrity of internal components, such as the at least one pin 112, the circuit board member 104, and the rigid chassis member 106. The flexible overmold 108 further functions to increase tolerance to misuse, due to increased viscoelastic properties of the flexible overmold 108. That is, a more optimal durometer measurement is obtained, as measured by a "A", "D", and/or "OO" durometer scale, which leads to improved flexibility of the quick disconnect waterproof connector assembly apparatus 100. Similarly, measured against a flexural modulus scale, which measures a material's resistance to bending, the present teachings provide a lower flexural modulus (than is currently available in connector housings), thereby providing a high tolerance to bending, impacting, or misuse of the quick disconnect waterproof connector assembly apparatus 100, because of greater flexibility.

The quick disconnect waterproof connector assembly apparatus 100 further comprises an affixing member 110*a* and/or 110*b*. In one embodiment, an affixing member 110*a* comprises a threaded bolt element, wherein an axis of rotation is substantially orthogonal to a plane of a rigid chassis member 106. The affixing member 110*a* is disposed along the axis of rotation through a threaded hole in the rigid chassis member 106. The affixing member 110*a* is disposed at a distal end of the quick disconnect waterproof connector assembly apparatus 100, distal to the quick disconnect interface member 102. The threaded bolt element is adapted to fit a threaded female receptacle, disposed on a two-way radio. A user may fit the threaded bolt element into the two-way radio threaded female receptacle, and rotate the threaded bolt element of the affixing member 110*a* to affix the quick disconnect waterproof connector assembly apparatus 100 securely thereto. The threaded bolt element of the affixing member 110*a* is adapted to tighten a connector electrical mating surface substantially evenly to a two-way radio electrical mating surface. The affixing member 110*b* comprise a clip member, adapted for securely affixing the quick disconnect waterproof connector assembly apparatus 100 to a two-way radio. Although a user may inadvertently misuse the quick disconnect waterproof connector assembly apparatus 100, by not aligning the connector electrical mating surface with the two-way radio electrical mating surface, the present disclosure allows for such misuse in multiple ways. As described above, in one embodiment, the at least one pin 112 comprises a spring coupling, having a restoring force which is substantially orthogonal to a plane of the circuit board member 104. The restoring force of a distal pin end 112*b* acts outwardly from the bottom surface of the quick disconnect waterproof connector assembly apparatus 100. If a user misaligns the connector electrical mating surface of the quick disconnect waterproof connector assembly apparatus 100, the restoring force of the distal pin end 112*b* functions to allow the pin to be depressed inwardly, without damaging the at least one pin 112.

As previously described above, users of devices to which this art pertains often misuse the connector interfaces, such as for example over-tightening an affixing member, such as a threaded bolt element, while the radio connector interface and the connector interface are misaligned, which can lead to multiple operational problems. The present teachings allow for such misuse, without damage to the devices and without compromising operational integrity. Because the at least one pin 112 has a distal pin end 112*b*, which is spring-loaded, the quick disconnect waterproof connector assembly apparatus 100 can tolerate greater degrees of misalignment of reciprocal electrical contacts on the two-way radio connector interface. That is, if a user misaligns the distal pin end 112*b* with a reciprocal electrical contact on the two-way radio, the spring-loaded distal pin end 112*b* functions to retract into a cylindrical body of the at least one pin 112, while maintaining proper electrical impedance, even though the mechanical length has changed. Moreover, the spring-loaded at least one pin 112 can provide a kind of "restoring" force when there are small misalignments, effectively "snapping" the at least one pin 112 into proper alignment.

Referring now to FIG. 1*b*, in one embodiment of the present teachings, a waterproof connector assembly apparatus 101, adapted to provide electromagnetic interface connectivity between a communications accessory device and a two-way radio is disclosed. The waterproof connector assembly apparatus 101 generally comprises a cable member 103, a circuit board member 104, a rigid chassis member 106, a flexible overmold 108, and an affixing member 110*a* 110*b*. The cable member 103 is adapted for transferring bi-directional electromagnetic signals, such as for example audio, data, PTT, and further adapted to have a strain relief element. The strain relief element functions to reduce a net torque on the waterproof connector assembly apparatus 101 by absorbing torque force at a terminal end of the strain relief element. The circuit board member 104 is adapted to provide affixing means for at least one pin 112, wherein the at least one pin 112 is adapted to provide an electromagnetic communications interface between the cable member 103 and the two-way radio. The rigid chassis member 106 is adapted for mounting the circuit board member 104 securely therein. The flexible overmold 108 is adapted to encapsulate the circuit board member 104, and further adapted to encapsulate the rigid chassis member 106, wherein the at least one pin is further adapted to protrude partially from the flexible overmold 108. The process to manufacture the overmold 108 described above with respect to the quick disconnect waterproof connector assembly apparatus 100 is the same as a process for manufacturing the overmold 108 for the waterproof connector assembly apparatus 101. The waterproof connector assembly apparatus 101 further comprises an affixing member 110*a* 110*b*, adapted to affix the waterproof connector assembly apparatus to the two-way radio.

Figure 2:
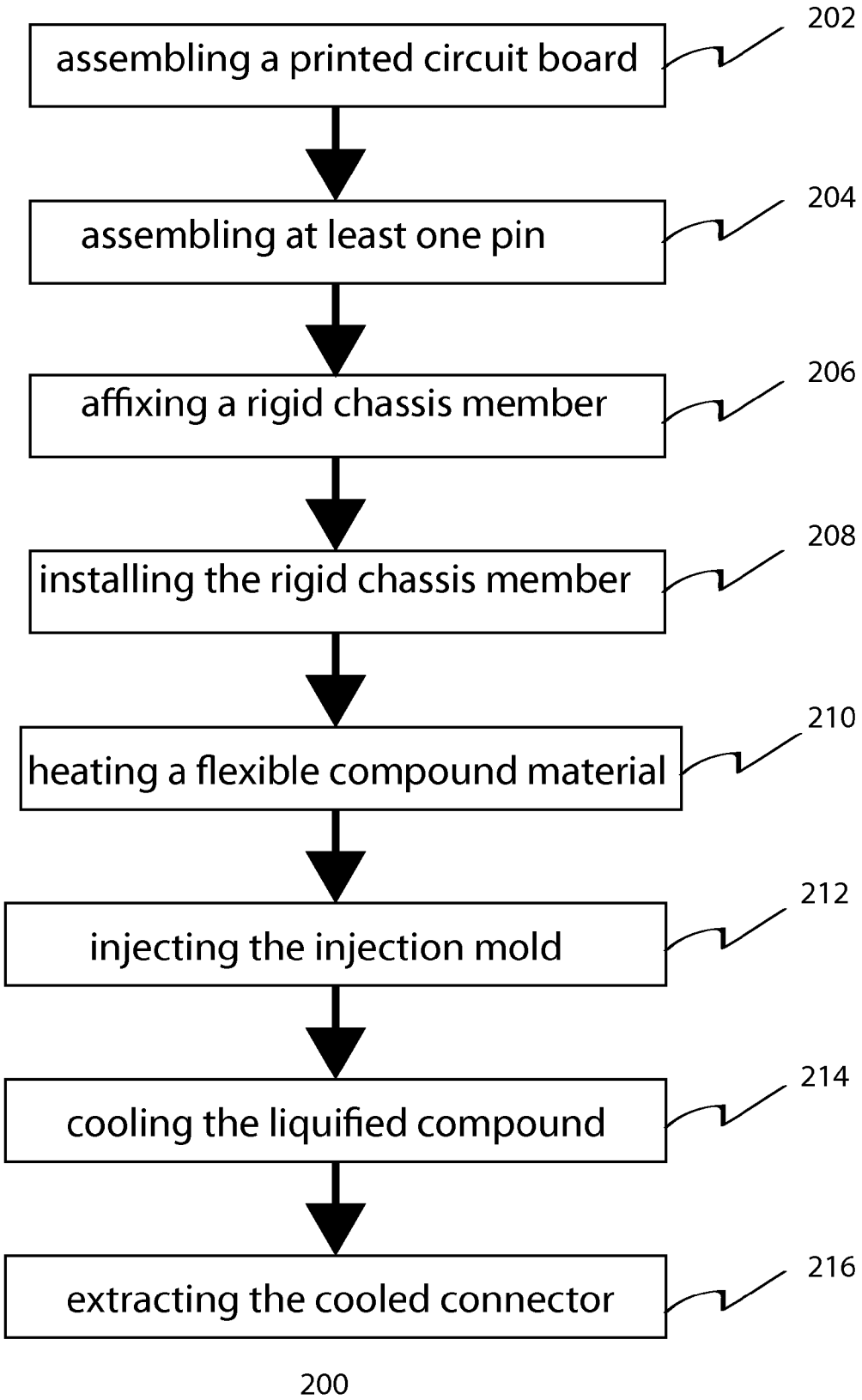
FIG. 2 illustrates a method of manufacture of a waterproof connector assembly apparatus, according to one embodiment of the present teachings.

Referring now to FIG. 2, a method of manufacturing a waterproof connector assembly apparatus 200 is disclosed. The method of manufacturing a waterproof connector assembly apparatus 200 generally comprises the steps of: assembling a printed circuit board 202, assembling at least one pin 204, affixing a rigid chassis member 206, installing the rigid chassis member 208, heating a flexible compound material 210, injecting an injection mold 212, cooling a liquefied compound 214, and extracting a cooled connector 216.

The method of manufacturing a waterproof connector assembly apparatus 200 comprises a step of assembling a printed circuit board 202, having at least one layer, and a plurality of holes. In some embodiments, a multi-layered printed circuit board is employed, wherein layers may consist of power, ground, and/or connections. The plurality of holes are adapted for fitting the at least one pin therethrough. At a next step of assembling at least one pin 204, the at least one pin is constructed to have a proximate end and a distal end, wherein the at least one pin is inserted into one of the plurality of holes disposed on the assembled printed circuit board, whereby the at least one pin is affixed to one of the plurality of holes disposed therein. At a next step of affixing a rigid chassis member 206 to the assembled printed circuit board, the rigid chassis may be mechanically or chemically affixed thereto. At a next step of installing the rigid chassis member 208 into an injection mold, the process is adapted to protect the printed circuit board and the at least one pin from excessive heating. At a next step of heating a flexible compound material 210, the flexible compound material is heated until liquefied. At a next step of injecting the liquefied flexible compound material 212, the liquefied flexible compound material is injected into the injection mold, whereby the liquefied compound material flows within the injection mold to substantially cover the printed circuit board, the rigid chassis member, wherein the at least one pin is partially covered while having a distal portion of the at least one pin protruding outwardly from the rigid chassis member. At a next step 214 of cooling the liquefied flexible compound material, the liquefied compound that was injected into the injection mold is cooled. At a next step of extracting the cooled waterproof connector 216 assembly apparatus, the cooled waterproof connector is removed from the injection mold.

Those skilled in the art will appreciate that the present teachings may be practiced with other system configurations, including hand-held devices, multiprocessor systems, microprocessor-based or programmable consumer electronics, network PC's, minicomputers, mainframe computers, and the like. The present teachings may also be practiced in distributed computing environments where tasks are performed by remote processing devices that are linked through a communications network. In a distributed computing environment, program modules may be located in both local and remote memory storage devices.

The computer described herein above may operate in a networked environment using logical connections to one or more remote computers. These logical connections can be achieved using a communication device that is coupled to or be a part of the computer; the present teachings are not limited to a particular type of communications device. The remote computer may be another computer, a server, a router, a network PC, a client, a peer device or other common network node, and typically includes many or all of the elements described above relative to the computer. The logical connections include a local-area network (LAN) and a wide-area network (WAN). Such networking environments are commonplace in office networks, enterprise-wide computer networks, intranets and the Internet, which are all types of networks.

When used in a LAN-networking environment, the computer is connected to the local network through a network interface or adapter, which is one type of communications device. When used in a WAN-networking environment, the computer typically includes a modem, a type of communications device, or any other type of communications device for establishing communications over the wide area network, such as the Internet.

The foregoing description illustrates exemplary implementations, and novel features, of aspects of a waterproof connector assembly apparatus and method for providing a connector for a two-way radio. Alternative implementations are suggested, but it is impractical to list all alternative implementations of the present teachings. Therefore, the scope of the presented disclosure should be determined only by reference to the appended claims, and should not be limited by features illustrated in the foregoing description except insofar as such limitation is recited in an appended claim.

While the above description has pointed out novel features of the present disclosure as applied to various embodiments, the skilled person will understand that various omissions, substitutions, permutations, and changes in the form and details of the present teachings illustrated may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprising".

What is claimed is:

1. A quick disconnect waterproof connector assembly apparatus, adapted to provide electromagnetic interface connectivity between a communications accessory device and a two-way radio, comprising:

a.) a quick disconnect interface member, adapted for bi-directional transfer of electromagnetic signals, further adapted to facilitate quick connection and disconnection of the communications accessory device;

b.) a circuit board member, adapted to provide affixing means for at least one pin, wherein the at least one pin is adapted to provide an electromagnetic communications interface;

c.) a rigid chassis member, adapted for mounting the circuit board member;

d.) a flexible overmold, adapted to encapsulate the circuit board member, further adapted to encapsulate the rigid chassis member, wherein the at least one pin is further adapted to protrude partially from the flexible overmold, and;

e.) an affixing member, adapted to affix the waterproof connector assembly apparatus to the two-way radio.

2. The quick disconnect waterproof connector assembly apparatus of claim 1, wherein the affixing member comprises a threaded bolt element or a clip member.

3. The quick disconnect waterproof connector assembly apparatus of claim 1, wherein the bi-directional electromagnetic signals are audio or data signals.

4. The quick disconnect waterproof connector assembly apparatus of claim 1, wherein the bi-directional electromagnetic signals comprise audio and data signal elements, transferred in parallel or in serial.

5. The quick disconnect waterproof connector assembly apparatus of claim 1, further adapted to provide a serial interface or a parallel interface.

6. The quick disconnect waterproof connector assembly apparatus of claim 1, wherein the flexible overmold comprises plastic or rubber.

7. The quick disconnect waterproof connector assembly apparatus of claim 1, wherein the communications accessory device is selected from the group consisting of, a position reporting microphone, a speaker-microphone, a GPS microphone, a headset, or an earphone.

8. A waterproof connector assembly apparatus, adapted to provide electromagnetic interface connectivity between a communications accessory device and a two-way radio, comprising:

a.) a cable member, adapted to transfer bi-directional electromagnetic signals, having a strain relief element;

b.) a circuit board member, adapted to provide affixing means for at least one pin, wherein the at least one pin is adapted to provide an electromagnetic communications interface;

c.) a rigid chassis member, adapted for mounting the circuit board member;

d.) a flexible overmold, adapted to encapsulate the circuit board member, further adapted to encapsulate the rigid chassis member, wherein the at least one pin is further adapted to protrude partially from the flexible overmold, and;

e.) an affixing member, adapted to affix the waterproof connector assembly apparatus to the two-way radio.

9. The waterproof connector assembly apparatus of claim 8, wherein the affixing member comprises a threaded bolt element or a clip member.

10. The waterproof connector assembly apparatus of claim 8, wherein the bi-directional electromagnetic signals are audio or data signals.

11. The waterproof connector assembly apparatus of claim 8, wherein the bi-directional electromagnetic signals comprise audio and data signal elements, transferred in parallel or in serial.

12. The waterproof connector assembly apparatus of claim 8, further adapted to provide a serial interface or a parallel interface.

13. The waterproof connector assembly apparatus of claim 8, wherein the flexible overmold comprises plastic or rubber.

14. The waterproof connector assembly apparatus of claim 8, wherein the communications accessory device is selected from the group comprising, a position reporting microphone, a speaker-microphone, a GPS microphone, a headset, or an earphone.

* * * * *